US008919339B2

(12) United States Patent
Mazzetti et al.

(10) Patent No.: US 8,919,339 B2
(45) Date of Patent: Dec. 30, 2014

(54) SUPPORT AND SLIDING SYSTEM FOR EXTRACTABLE OVEN SHELVES

(75) Inventors: Cristina Mazzetti, Varese (IT); Stefano Salina, Gallarate (IT); Michele Venezia, Taino (IT)

(73) Assignee: Whirlpool Corporation, Benton Harbor, MI (US)

( * ) Notice: Subject to any disclaimer, the term of this patent is extended or adjusted under 35 U.S.C. 154(b) by 365 days.

(21) Appl. No.: 12/640,165

(22) Filed: Dec. 17, 2009

(65) Prior Publication Data

US 2010/0155552 A1 Jun. 24, 2010

(30) Foreign Application Priority Data

Dec. 18, 2008 (IT) ..... VA20080027 U

(51) Int. Cl.
*F24C 15/16* (2006.01)

(52) U.S. Cl.
USPC ..... 126/339; 126/337 R

(58) Field of Classification Search
USPC ..... 312/408, 410; 211/153; 126/337 R
See application file for complete search history.

(56) References Cited

U.S. PATENT DOCUMENTS

| | | | | | |
|---|---|---|---|---|---|
| 1,013,313 | A | * | 1/1912 | Richardson | 126/339 |
| 1,191,198 | A | * | 7/1916 | Shailor | 126/339 |
| 1,896,307 | A | | 2/1933 | Hatch | |
| 1,974,983 | A | | 9/1934 | Cook | |
| 2,466,360 | A | | 4/1949 | Bitney | |
| 2,742,559 | A | * | 4/1956 | Edelman | 99/340 |
| 2,875,016 | A | * | 2/1959 | Fry | 312/351 |
| 3,122,134 | A | * | 2/1964 | Reeves | 126/41 R |
| 3,791,371 | A | | 2/1974 | Oatley | |
| 4,476,848 | A | | 10/1984 | Protas | |
| 6,148,813 | A | * | 11/2000 | Barnes et al. | 126/339 |
| 7,703,453 | B2 | * | 4/2010 | Hughes | 126/339 |
| 2006/0102015 | A1 | | 5/2006 | Baker et al. | |

FOREIGN PATENT DOCUMENTS

| | | |
|---|---|---|
| DE | 3505807 A1 | 8/1986 |
| GB | 2246855 | 2/1992 |

* cited by examiner

*Primary Examiner* — Amy J Sterling

(57) ABSTRACT

A support and sliding system for extractable shelves that are installable in a cooking oven that allows improved sizing of the usable surface of the shelves and the better utilization of oven volume.

19 Claims, 2 Drawing Sheets

SUPPORT AND SLIDING SYSTEM FOR EXTRACTABLE OVEN SHELVES

BACKGROUND OF THE INVENTION

1. Field of the Invention

The present invention relates to a support and sliding system for an extractable shelf for an oven, preferably of the household type.

2. Description of the Related Art

Household ovens equipped with a cavity for cooking foods that is sealable during use by means of a door, are known in the art. The cavities are normally enamel-coated and comprise: a top wall, a bottom wall, two opposing sidewalls and a rear wall on which a bulkhead can be positioned, which at times is provided with a central opening and contains a fan.

Support and sliding systems for extractable shelves for the ovens, such as cookie sheets, dripping pans or grills are known in the art. The shelves are normally used to support the foods during the cooking process.

Support and sliding systems that utilize the use of guides made of metal rod to facilitate the insertion of the shelves, are similarly known.

Shapes of the guides such as to stop the sliding of the shelf, both during insertion into the cavity to prevent contact with the enamel of the cavity rear wall, when the shelf is inserted in the cavity itself, and during the extraction of the shelf in order to position the foods to be cooked or removing the foods once cooked without having to extract the entire shelf from the guides and without it falling out, are likewise known.

SUMMARY OF THE INVENTION

An aspect of the present invention is a support and sliding system for the shelves that can guarantee increased sizing of the usable area of the shelf, also maximizing the usable volume of the oven cavity, in which such system is arranged.

A second aspect of the present invention is that of offering a support and sliding system for the shelves that can guarantee the stability of the shelf positioned in its position of maximum extraction from the oven cavity, without it coming out of the guides.

A third aspect of the present invention is that of offering a support and sliding system for the shelves that can prevent contact with the rear wall of the cavity when the shelf is positioned in the position of maximum insertion in the oven cavity and that can be well guided during insertion.

Another aspect of the present invention is that of offering a support and sliding system combined with a sliding shelf that impedes incorrect insertion of the shelf in the system.

The aspects of the invention can be achieved by means of a shape of the elements according to what is described in the main claim and in the claims that depend on it.

BRIEF DESCRIPTION OF THE DRAWINGS

Further advantages and characteristics of the present invention will be evident from the detailed description provided below as a non-limiting example, with reference to the attached drawings, in which.

DETAILED DESCRIPTION OF THE PREFERRED EMBODIMENTS

With reference to the drawings, a cavity of a household oven is described, in which two support and sliding frames S1, S2 are attached for an extractable shelf or grill R. Such frames S1 and S2 are preferably made of metal rod, preferably stainless steel, even if other metal materials and any enamel coatings may be used. Each of such frames preferably exhibits at the ends two vertical rods E1, E2 and at least two substantially horizontal elements L1 L2, which define a support and sliding guide G for a sliding shelf R.

The two vertical rods can be utilized, in accordance with what is described in DE 3505807 A1, for anchoring the frames to the walls of the oven. Alternatively or additionally, screwable fasteners can be provided.

Figure 1:
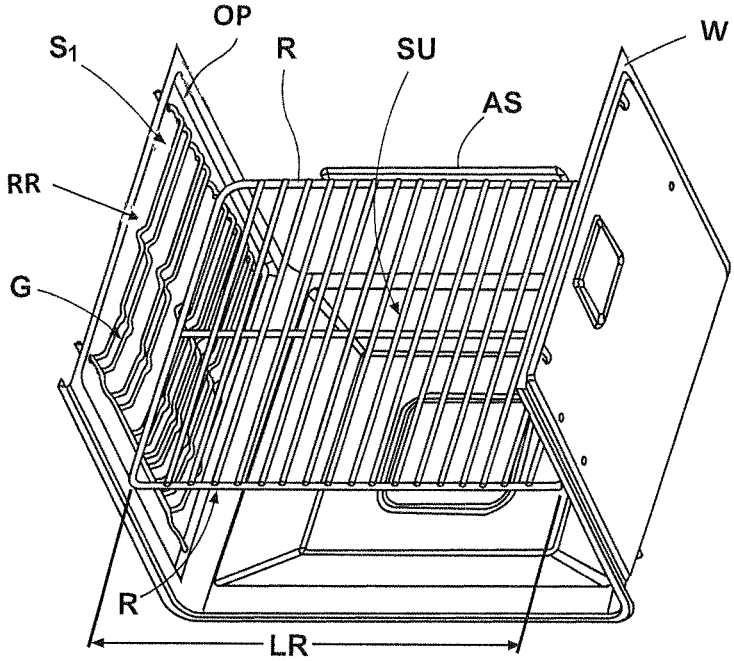
FIG. 1 shows a perspective view of a portion of an oven cavity that exhibits a support and sliding system of the grills and shelves according to the invention.
Figure 2:
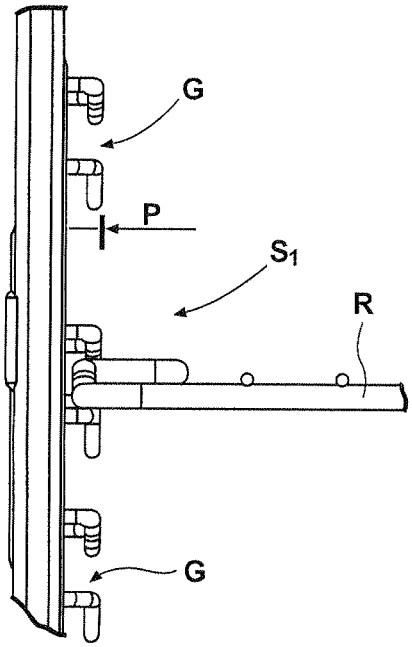
FIG. 2 shows the frontal view of a detail of FIG. 1.
Figure 3:
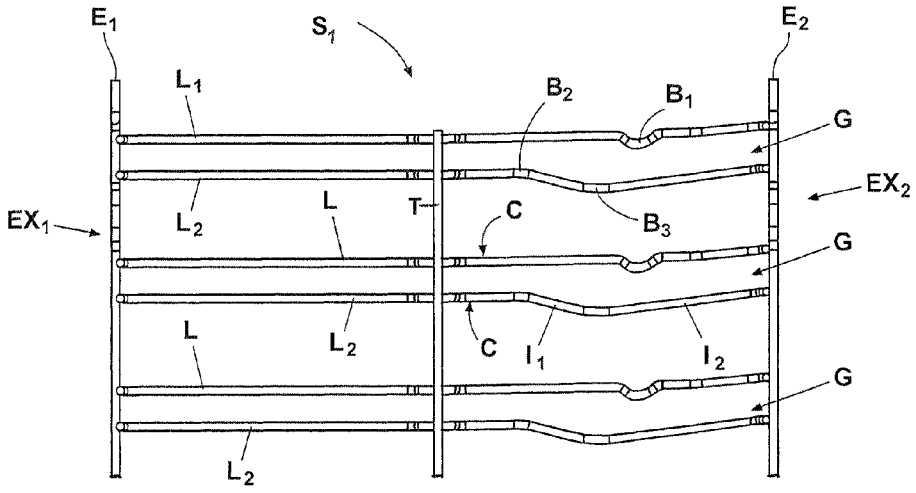
FIG. 3 shows in detail one of the two supports utilized in the cavity of FIG. 1.

The horizontal elements L1, L2 are preferably rod-shaped with ends that are bent and positioned terminating against the corresponding sidewall of the cavity (the perspective view of which is shown in FIGS. 1 and 2), in which the central part C extends linearly over almost the entire length of the sidewall of the oven cavity, in which the same frame is attached. In a different embodiment, the central part of the horizontal elements L1, L2 exhibits some profiles B1, B2, B3, B4, both in the end EX1 that can be attached in proximity to the rear wall of the oven cavity and in proximity to the opposite end EX2, which are suitable for preventing the sliding of the extractable shelf R beyond a predetermined position. Furthermore, the central parts C may exhibit some inclined portions I1 I2, which are suitable for defining a constrained insertion path of the extractable shelf within the guide in such a way as to prevent it from coming out during the operations of preparing the foods to be cooked and during the removal of cooked foods.

The depth P of each support frame S1, S2 is fixed and substantially corresponds to the length of the bent ends of the horizontal elements and is substantially the same for all of the elements of the frame. This characteristic allows the frame to be substantially parallel to the oven sidewall to which it is attached.

The depth P of the support and sliding frame determines the maximum width LR of the sliding shelf. In fact, an excessive dimension of the latter impedes the positioning and the sliding of the shelf R in the guides G. It follows that to increase the usable surface SU of the supported sliding shelf and, in relation thereto, the usable volume of the oven cavity in which it is introduced, such depth P must be minimized. The applicant has performed a study according to which the maximum depth of 10 millimeters, well below what is currently known in the art (which is typically 15 millimeters), allows to achieve an oven cavity for household use with a capacity of over 60 liters. Currently on the market, the available usable volumes of the cavities are of about 50 liters.

Figure 4:
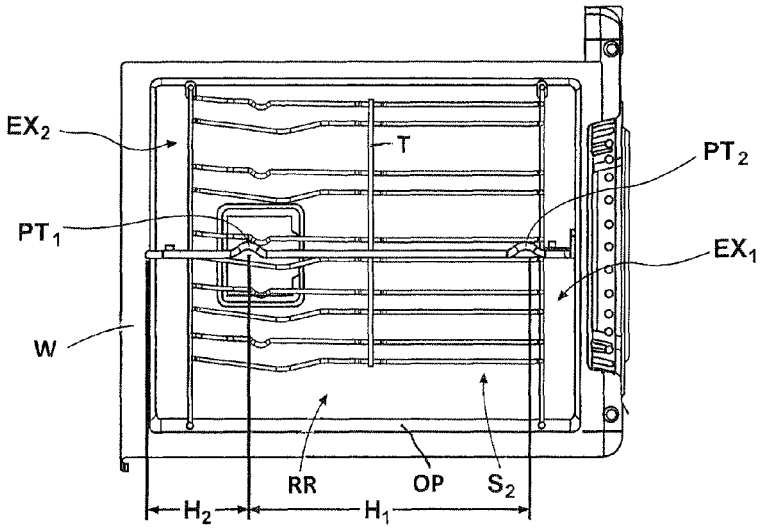
FIG. 4 shows a longitudinal section of an oven cavity in which a sliding shelf, which slides on supports according to the invention, is in the position of maximum insertion into the cavity.

This degree of projection of the guides G is accomplished in a manner clearly shown in FIGS. 1 and 4 wherein each sidewall W is formed with a recessed region RR in which a respective support frame $S_1$, $S_2$ is anchored. As shown, each recessed region RR is created by a respective sidewall W including out-turned portions OP, with the upstanding rods $E_1$, $E_2$ being directly secured at select ones of the out-turned portions OP within the recessed region RR and the guides or guide elements G being located outside the respective recessed region RR and projecting into the oven cavity by the above-described depth.

Furthermore, according to the invention, at least one metallic transversal element T attached to each horizontal element L1 L2, following a direction running transverse to the guides, preferably perpendicular, is present in each support and sliding frame.

Such transversal element T is necessary to prevent the deformation of the guides made of metal wire, preferably with a diameter equal to 3.8 millimeters, and the attendant fall of the shelf R when it is loaded with the food to be cooked, and especially when this shelf is found in the position of maximum extraction. In this way, the user may have an extensive sliding work shelf that proves to be particularly stable.

Such a transversal element T can likewise be utilized to anchor the support and sliding frame to the sidewall of the cavity.

According to what is shown in FIG. 4, the shelf R, whether a grill, a dripping pan, a cookie sheet or a support assimilable thereto, preferably exhibits protrutions or profiles PT1, PT2 that cooperate with the profiles B1, B2, B3, B4 of the frames during the sliding and impede its movement beyond a predetermined extension. Similarly, the same protrutions and/or profiles PT1, PT2 cooperate with the inclined portions I1, I2 of the guides G in order to prevent the incorrect insertion of the sliding shelf R according to an incorrect direction, but allowing only the insertion of the shelf in the guide according to a correct direction (polarized insertion). In a preferred embodiment, the profiles PT1 PT2 and the profiles B1, B2, B3, B4 of the support and sliding frames are placed in a precise relative arrangement in such a way as to guarantee improved stability to the shelf R in the maximum extraction position. In detail, the arrangement provides for that their interaxial distance H1 is on the order of three times the distance H2 between the mouth of the cavity and the profile B1 closest to the opposite end EX2.

In a further variant, the shelf exhibits some anti-slip edges AS suitable for preventing the objects placed on the sliding shelf R from falling off, when it is moving.

According to the foregoing, an oven is described that achieves all of the objects described in the introductory part of the present invention.

Further variants of the invention, which can be achieved through the combination of elements described above, are considered part of the same teaching.

We claim:

1. An oven comprising:

an oven cavity including a top wall, a bottom wall, a rear wall and opposing sidewalls, each of the opposing sidewalls being formed with a recessed region;

a shelf; and first and second support frames, each of the first and second support frames being anchored within a respective said recessed region in the opposing sidewalls of the oven cavity and including at least two substantially horizontal guide elements interconnected by multiple upstanding rods which are secured within a common said respective said recessed region, each of the guide elements including a central part and terminal ends, with the central part extending almost an entire length of a respective one of the opposing sidewalls of the oven cavity and the terminal ends being bent so as to be arranged against the respective one of the opposing sidewalls such that the guide elements are located outside the respective recessed region and project into the oven cavity from the respective one of the opposing sidewalls, wherein the shelf extends across the oven cavity and is supported on the first and second support frames with the guide elements allowing sliding of the shelf in a direction substantially horizontal relative to the opposing sidewalls of the oven cavity.

2. The oven according to claim 1, further comprising:

at least one protrusion on the shelf; and at least one profile provided on the central part of at least one of the guide elements, wherein the at least one protrusion cooperates with the at least one profile to impede sliding movement of the shelf beyond a predetermined extension.

3. The oven according to claim 2, wherein the shelf includes at least two protrusions spaced by a distance on the order of three times a distance between a mouth of the oven cavity and the at least one profile.

4. The oven according to claim 1, wherein the central part of each of the guide elements includes at least one inclined portion.

5. The oven according to claim 1, wherein each of the first and second support frames are substantially parallel to the opposing sidewalls of the oven cavity.

6. The oven according to claim 5, wherein each of the first and second support frames includes multiple upstanding rods interconnecting the guide elements, with the multiple upstanding rods being directly anchored to the oven cavity.

7. The oven according to claim 1, wherein each of the opposing sidewalls is formed with out-turned portions creating the respective said recessed region.

8. The oven according to claim 7, wherein the upstanding rods are directly secured at select ones of the out-turned portions.

9. An oven comprising:

an oven cavity including a top wall, a bottom wall, a rear wall and opposing sidewalls, each of the opposing sidewalls being formed with out-turned portions creating a recessed region;

a shelf; and first and second support frames, each of the first and second support frames including at least two substantially horizontal guide elements interconnected by multiple upstanding rods, each of the guide elements including a central part and terminal ends, with the central part extending almost an entire length of a respective one of the opposing sidewalls of the oven cavity, each of the upstanding rods of the first and second support frames being positioned and secured within a respective said recessed region in the opposing sidewalls of the oven cavity, the terminal ends of each of the guide elements being bent and arranged within a common said respective said recessed region in the opposing sidewalls, and the central part of each of the guide elements being located outside the respective said recessed region and projecting into the oven cavity by a depth of less than or equal to 10 millimeters, wherein the shelf extends across the oven cavity and is supported on the first and second support frames with the guide elements allowing sliding of the shelf in a direction substantially horizontal relative to the opposing sidewalls of the oven cavity.

10. The oven according to claim 9, wherein the upstanding rods are directly secured at select ones of the out-turned portions.

11. The oven according to claim 9, further comprising:

at least one protrusion on the shelf; and at least one profile provided on the central part of at least one of the guide elements, wherein the at least one protrusion cooperates with the at least one profile to impede sliding movement of the shelf beyond a predetermined extension.

12. The oven according to claim 11, wherein the shelf includes at least two protrusions spaced by a distance on the order of three times a distance between a mouth of the oven cavity and the at least one profile.

13. The oven according to claim 9, wherein the central part of each of the guide elements includes at least one inclined portion.

14. The oven according to claim 9, wherein each of the first and second support frames are substantially parallel to the opposing sidewalls of the oven cavity.

15. The oven according to claim 1, wherein each of the recessed regions comprises a generally planar portion of a respective opposing sidewall that is set further back from the rest of the respective opposing sidewall.

16. The over according to claim 15, wherein the opposing sidewalls extend vertically.

17. The oven according to claim 9, wherein each of the recessed regions comprises a generally planar portion of a respective opposing sidewall that is set further back from the rest of the respective opposing sidewall.

18. The over according to claim 1, wherein the opposing sidewalls extend vertically.

19. The oven according to claim 1, wherein the guide elements project into the oven cavity from the respective one of the opposing sidewalls by a depth of less than or equal to 10 millimeters.

* * * * *